US005893791A

United States Patent [19]

Wilkinson

[11] Patent Number: 5,893,791

[45] Date of Patent: Apr. 13, 1999

[54] REMOTE CONTROLLED ROLLING TOY

[76] Inventor: William T. Wilkinson, P.O. Box 73, Salem, N.J. 08079

[21] Appl. No.: 08/867,486

[22] Filed: Jun. 2, 1997

[51] Int. Cl.[6] ..... A63H 30/04

[52] U.S. Cl. ..... 446/456; 446/269; 446/279; 446/471

[58] Field of Search ..... 446/269, 279, 446/431, 454, 455, 456, 465, 470, 471

[56] References Cited

U.S. PATENT DOCUMENTS

| | | | |
|---|---|---|---|
| 742,250 | 10/1903 | Spencer . | |
| 800,741 | 10/1905 | Howard | 446/269 |
| 811,775 | 2/1906 | Keen et al. | 446/269 |
| 1,209,920 | 12/1916 | Young | 446/269 |
| 2,104,636 | 1/1938 | Burcham . | |
| 2,277,057 | 3/1942 | Bach . | |
| 2,949,697 | 8/1960 | Licitis . | |
| 3,102,362 | 9/1963 | Neal . | |
| 3,106,397 | 10/1963 | Lacey . | |
| 3,453,773 | 7/1969 | Compton . | |
| 3,500,579 | 3/1970 | Bryer . | |
| 3,555,475 | 1/1971 | Szczepanski . | |
| 3,667,156 | 6/1972 | Tomiyama . | |
| 3,734,500 | 5/1973 | Cooper . | |
| 3,798,835 | 3/1974 | McKeehan . | |
| 3,804,411 | 4/1974 | Hendry . | |
| 3,843,125 | 10/1974 | Loose . | |
| 4,346,893 | 8/1982 | Landsinger et al. . | |
| 4,391,224 | 7/1983 | Adler . | |
| 4,438,588 | 3/1984 | Martin . | |
| 4,471,567 | 9/1984 | Martin . | |
| 4,501,569 | 2/1985 | Clark, Jr. . | |
| 4,541,814 | 9/1985 | Martin | 446/456 |
| 4,601,675 | 7/1986 | Robinson . | |
| 4,726,800 | 2/1988 | Kobayashi . | |
| 4,737,134 | 4/1988 | Rumsey . | |
| 4,822,044 | 4/1989 | Perkitny . | |
| 4,927,401 | 5/1990 | Sonesson . | |
| 5,041,049 | 8/1991 | Wax | 446/269 |
| 5,041,051 | 8/1991 | Sonesson | 446/456 |
| 5,066,011 | 11/1991 | Dykstra | 446/485 |
| 5,072,938 | 12/1991 | Shin . | |
| 5,135,427 | 8/1992 | Suto . | |
| 5,427,561 | 6/1995 | Eichhorn . | |
| 5,439,408 | 8/1995 | Wilkinson . | |

FOREIGN PATENT DOCUMENTS

| | | | |
|---|---|---|---|
| 794261 | 2/1936 | France | 446/465 |
| 56650 | 10/1952 | France | 446/470 |
| 1184170 | 2/1959 | France . | |
| 54363 | 11/1890 | Germany | 446/269 |
| 233177 | 4/1911 | Germany | 446/269 |
| 2012239 | 10/1971 | Germany | 446/431 |
| 88 03 308 U | 3/1988 | Germany . | |
| 6407 | of 1914 | United Kingdom . | |
| 1292441 | 9/1968 | United Kingdom . | |

*Primary Examiner*—Robert A. Hafer
*Assistant Examiner*—Jeffrey D. Carlson
*Attorney, Agent, or Firm*—Connolly & Hutz

[57] ABSTRACT

A simulated game using miniature animate or inanimate objects which are intended to move in a direction and/or toward or away from each other includes utilizing a hollow ball or other rolling toy for at least some of the miniature objects. Movement of the toy is controlled by a remote controlled unit. In a preferred practice of the invention a frame is detachably mounted over the toy. The frame supports three dimensional structure simulating the object.

7 Claims, 3 Drawing Sheets

REMOTE CONTROLLED ROLLING TOY

BACKGROUND OF THE INVENTION

One of the oldest types of toys is a ball. Balls have been used for various amusement devices ranging from basic rolling and throwing games to more sophisticated games having varying degrees of rules.

In recent times radio controlled vehicles, such as cars and airplanes have become quite popular. An advantage of these remote controlled vehicles is the ability to control the direction of movement of such toys. This advantage is not shared by conventional balls. Attempts have been made to provide some variety in entertainment value of balls by incorporating different mechanisms that cause the balls to move in a random manner when thrown or rolled.

Various types of games have been known which are miniaturized versions simulating full size games. For example, games are available on a game board to simulate football, hockey, racing, etc. It would be desirable to enhance the playing of such games.

SUMMARY OF THE INVENTION

An object of this invention is to utilize remote controlled rolling toys, such as balls, for playing simulated games.

A further object of this invention is to provide such remote controlled toys which may be packaged in sets as in components.

A still further object of this invention is to provide a remote controlled toy, such as a ball, in the form of a simulated object.

In accordance with this invention a simulated game using miniature animate and/or inanimate objects which are intended to move in a direction and/or toward or away from each other includes utilizing a ball or other rolling toy for at least some of the miniature objects. Movement of the toy is controlled by a remote controlled unit.

In one practice of the invention a number of such balls is provided, each of which includes a magnet.

The toys may have their external appearance altered such as by decorating the toy to simulate corresponding objects such as animate objects which may be miniature size versions or may be in caricature form or may be a cartoon character.

In the preferred practice of this invention a frame is detachably dropped over the ball. The frame supports the structure which forms the animate or inanimate object. As a result, it is possible to use the same ball for selectively supporting different objects.

THE DRAWINGS

DETAILED DESCRIPTION

The present invention is based upon the utilization of remote controlled balls or other rolling toys for functioning as objects of movement in various types of games. Any suitable drive structure may be utilized which is remote controlled in accordance with the broad practices of this invention. Specific reference is made to U.S. Pat. No. 5,439,408 and pending applications Ser. No. 442,891 filed May 17, 1995 now U.S. Pat. No. 5,533,921, and Ser. No. 676,405, filed Jul. 8, 1996 abandoned, all of the details of which are incorporated herein by reference thereto. Accordingly, various details in the description of balls or other rolling toys that may be used in the practice of this invention will be primarily directed to features not described in the aforenoted patent and application.

Essentially, the invention involves the utilization of a remote controlled rolling toys, such as a ball or balls, as objects in games utilizing movement of the objects. The balls can take various forms, such as being completely spherical or any other shape that lends itself to rolling such as cylindrical frustoconical, etc. Other suitable rolling toys are vehicles having rotating wheels.

The balls can have structures on the inside and/or outside that serve a decorative purpose or to impact the motion of the ball. Such structures can be permanent or can be detachable such as stick on's, screw on's, suction, snap on's, plug in, slip on, zip on, tie on, magnetic or any other readily detachable structure. The toys, such as balls, can be in different sizes as well as different shapes. In this respect such different types of toys can be included in the same set of components for a given game.

Figure 1:
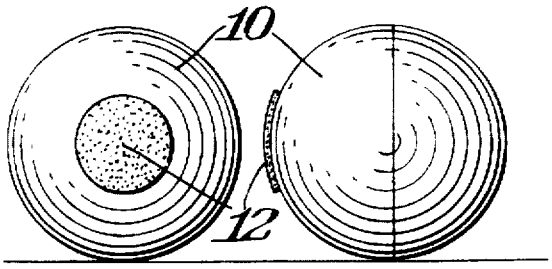
FIG. 1 is a front elevational view showing a pair of balls in accordance with one practice of the invention.

FIG. 1 shows a particularly advantageous form of toy shown as a ball 10. As shown therein each ball has a magnetic strip 12 attached to its outer surface in any suitable manner such as by an adhesive attachment. Other means of attachment could also be used. In addition, the magnets could be applied in various manners such as being on the inside of the ball and/or in various shapes rather than simply the circular shape shown in FIG. 1. Such magnets are particularly desirable since it permits a pair of balls to be magnetically attached to each other or depending on the polarity may cause the balls to be repulsed from each other. This lends itself to a variety of possibilities in games, such as tag where the attachment of a ball to another accomplishes the tag.

FIG. 1 illustrates the set of balls to be of the same size and shape and generally identical with each other. There may be times, however, that the balls should be of different sizes in accordance with what type of game is played. Thus, FIG. 2 shows a large ball 10 and a smaller ball 10.

Figure 2:
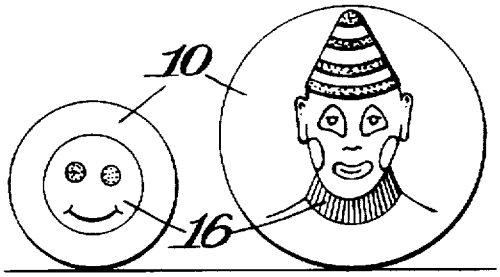
FIG. 2 is a front elevational view showing an alternative set of balls in accordance with this invention.

In the embodiment shown in FIG. 2 the external appearance of the ball is altered by incorporating some form of character or decoration 16. These characters or decorations could be applied in any suitable manner such as being a removable shell which is secured over the external surface of the balls so that the shells could be replaced where different games are used.

In addition to having the outside appearance altered the same balls may also include magnetic structures such as the magnetic strips of FIG. 1. Such magnetic structures not only lend themselves to a magnetic attraction of one ball to another, but also to other objects such as stationary structure utilized in a particular game or sport where it is intended to contact or avoid the structure.

A ball can be for a single use game or capable of multiple use games in accordance with this invention. Preferably, the balls are packaged in a kit as part of a set of balls with other structure to provide the necessary components for creating a particular type of game, toy or sport.

Figure 3:
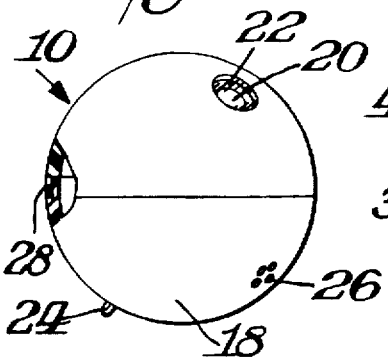
FIGS. 3–4 are side elevational views partly in section of still further balls which may be used in accordance with this invention.

If desired, the balls can be provided with some audio or visual structure. FIG. 3, for example, shows a ball 18 having a light 20 which is visible through a covering lens 22. A switch 24 is provided for selectively actuating the light 20. Such lights could remain constantly on or could be blinking lights. Alternatively or in addition the ball could incorporate voice chips, buzzers and other sound and/or visual mechanisms. A plurality of lights could be provided for the ball with each of the lights of the same color or with the lights of different colors. FIG. 3, for example, illustrates an audio device 26 such as a buzzer in combination with the light 20.

Figure 4:
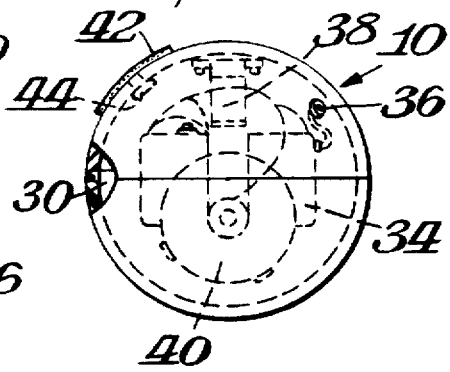
Figure 5:
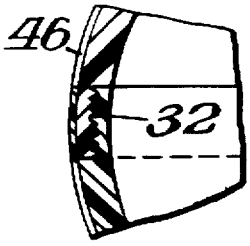
FIG. 5 is a fragmental enlarged cross-sectional view showing a portion of a ball in accordance with this invention.

Preferably, each ball is hollow and is formed by two semi-spherical shells secured together along the diameter of the ball. Any suitable manner of securement may be utilized. FIG. 3 illustrates a friction lock 28 between the ball halves. FIG. 4 shows a snap fit 30 as the means of securement, while FIG. 5 illustrates a threaded connection 32.

If desired, the balls can contain springs and/or pressure switches/contacts/points such as switch 24 that actuate various features of the ball such as the audio and/or visual features which may also be utilized to cause some action such as the balls exploding or coming apart.

Preferably, the balls are waterproof so that the balls could be used in various aquatic games as later described.

FIG. 4 shows the incorporation of a battery pack 34 within the ball 10. The battery pack could be rechargeable through use of the recharge connection 36 which permits the recharging by being plugged into any suitable power source such as a wall socket, battery recharger, etc. The ball 10 shown in FIG. 4 is also shown to include a drive unit which has a motor 38 and vibratory wheel 40.

If desired, instead of having the battery pack 34 rechargeable the power may be provided to the drive unit by ordinary batteries which would have to be periodically replaced.

FIG. 4 illustrates the provision of a decorative attachment 42 which is shown as being snapped into the outer surface of ball 10 by a snap fastener 44.

Where the ball is made in segments secured together to form the ball, the segments can be separated or opened manually such as by utilizing a snap fit or a screw/twist lock 32 or any other manner which, for example, might require the use of a key. Alternatively, the ball segments can be permanently sealed or joined.

FIG. 5 illustrates the incorporation of a traction rib 46 on the outer surface of the ball as described in the aforenoted patent and application.

Figure 6:
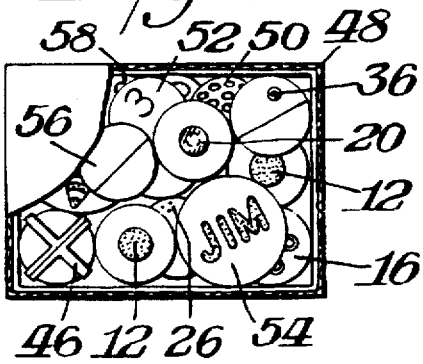
FIG. 6 is a top plan view partly broken away showing a kit containing various balls in accordance with this invention.

The remote controlled unit may take various suitable forms such as the types of units described in the aforenoted patent and application including radio remote control having no physical connection between the unit and the ball, or having a unit which is electrically connected by electrical wires. FIG. 6 shows a remote control unit 58 as one of the package components. Preferably the remote control unit not only actuates the drive unit of the ball, but also controls its speed and direction of movement.

The decorative alteration of the outer surface of the ball may accomplished in various manners such as by stick on's, painting, etc. Preferably, the decoration is in the form of a shell or frame which drops over and covers the ball with the shell thus being capable of having any two dimensional configuration such as a person, animal, etc. or which may include three dimensional structure, such as arms, legs, head, etc. Such a shell could be made of plastic or cloth and thus could simulate such diverse items as turtles or armadillos as well as cartoon characters, miniature versions of humans or other living objects or such cartoon or human objects in caricature form.

The shell may have a cut-out at one portion such as a portion which would correspond to the bottom of the shell to permit the utilization of, for example, three wheels either on the ball itself or on the shell so that the remote control unit would cause the ball to be propelled by rolling on the wheels.

FIG. 6 illustrates a set of balls mounted in a carton 48 which could package other components of a game or could be part of a bigger package having the other components. Alternatively, the balls themselves in the carton 48 may comprise the sole structural components of a game.

The invention may be practiced where the game is simply an amusement device for a person or even for a pet such as by having a dog or cat chase the ball. Preferably where used as a pet toy the person would play the amusement game by controlling the movement of the ball and its direction of travel.

In general, the ball or plural balls would be used in a game involving movement of the ball in a pre-determined or random direction or involving the movement of a ball toward or away from another object including another ball. The embodiment of the invention shown in FIG. 1, utilizing magnets 12, particularly lends itself to a variety of different games. For example, the magnets permit the balls 10 to be used in a game of tag where each of two players would independently move his or her own ball with the object being to have the ball of one player catch and tag the ball of the other player. The magnetic attachment would demonstrate that the tag is made. Another variation would be to provide three balls with magnets wherein the player controlling one ball would try to elude being caught or tagged by either of the two other balls.

Various types of games could be used in the practice of the invention. In general, such games involve utilizing miniature animate and/or inanimate objects which are intended to move in a direction and/or toward or away from each other. In one practice of the invention a ball would be used for at least some of the objects namely one or more of the objects and the movement of the ball would be controlled by a remote controlled unit, such as unit 58 of FIG. 6. Such types of games could include, for example, a toy to race around a race course or track. The toy could race or negotiate on an unobstructed track such as a straight track or oval. Alternatively, the track or course could include obstacles or could be in maze form. The ball might also, for example, simulate other types of balls in other sports such as the golf ball 50 shown in FIG. 6.

The ball could be a simulated billiard or pool ball or could be used as a bumper pool ball.

A further game would be a simulated football game where the object would be to advance the ball over a goal line with another player attempting to prevent such advance.

Further games include the following: a tug of war between two or more opposing balls; a tractor/weight pulling distance contest; a sumo wresting toy where the balls push against each other to force one ball out of a ring; a bowling ball to knock over pins; a bumper car game where balls race around the track and crash into each other; a hockey game where balls push a puck and/or other objects into a goal with other balls defending against scoring a goal; a soccer game where balls push a ball into a goal with other balls defending; a distance jumping game where balls are jumped off a ramp for distance; a water ball equipped with pedals, fins or propellers; a ball used for propelling a toy boat wherein the water balls or toy boats are used in aquatic races; a game having as its object the movement of the ball or a propelled object into a cup or hole; a game where the object is to roll the ball or propelled object; a game where balls are raced into a goal, hoop or over a line and/or through a slalom as in ski or water courses; a game where the object is for one ball to catch/chase another ball by magnetically engaging it or by engagement with other means such as velcro patches or sticky surfaces; amusement type games where the ball, for example, runs around a roller coaster track; a game of touch football; and a game where the ball is raced over a motor or bike track.

It is to be understood that in order to enhance the enjoyment of the game, the invention is preferably practiced by altering the external appearance of the ball so as to create a visual effect particularly one which follows the theme of the game being played or one which adds amusement such as to children. Thus, the balls could be decorated to simulate dolls, to assume personalities, or to simulate cartoon characters, animals, insects, and game participants. The external appearance may also be altered to provide designs, names, letters, numbers, etc. on the ball so as to distinguish one ball or one set of balls from others. FIG. 6, for example, illustrates the kit 48 to include a ball 52 having number identification and a ball 54 having letter or name identification. One of the balls 56 illustrated in FIG. 6 is an oval ball rather than a spherical ball. The ball 10 of FIG. 2 having a smiley face 16 is also shown in the kit, as well as the ball having traction ribs 46.

Figure 7:
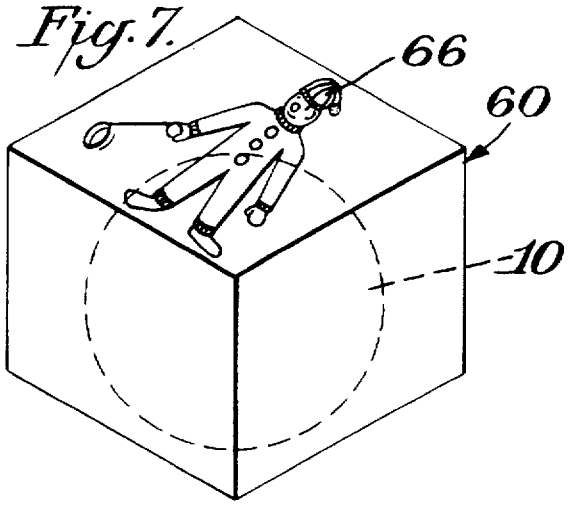
FIG. 7 is a perspective view of a ball having a frame detachably mounted thereon in accordance with this invention.
Figure 9:
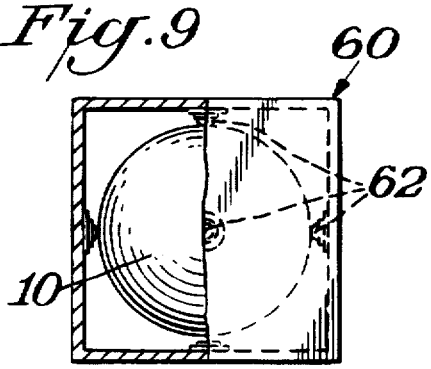
FIG. 9 is a top plan view of the embodiment of the invention shown in FIGS. 7–8.
Figure 8:
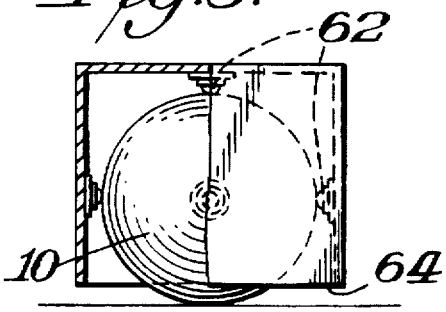
FIG. 8 is a side elevational view partly broken away of the embodiment of the invention shown in FIG. 7.

FIGS. 7–12 illustrate various practices of this invention which facilitate the utilization of the ball or other rolling toy to carry and thus take the form of a simulated object. FIGS. 7–9 illustrate a frame 60 detachably mounted to the ball 10 by simply dropping the frame over the ball. The inner surface of the frame would make multiple point contact with various portions of the ball. At each of these points of contact it is desired to utilize some structure that would prevent any undo interference with the rolling action of the ball. Such structure may, for example, be the provision of bearings 62 making rolling contact with the rolling ball. Preferably, the lower edge 64 of the frame terminates slightly above the lowest point of the ball so that the lower edge 64 will not contact the floor or other support surface and thereby interfere with the rolling movement of the ball. Alternatively, the lower edge may contact the floor in which case it is preferable to have bearings or other rolling structure on the lower edge of the frame to cooperate with the rolling action of the ball.

Figure 10:
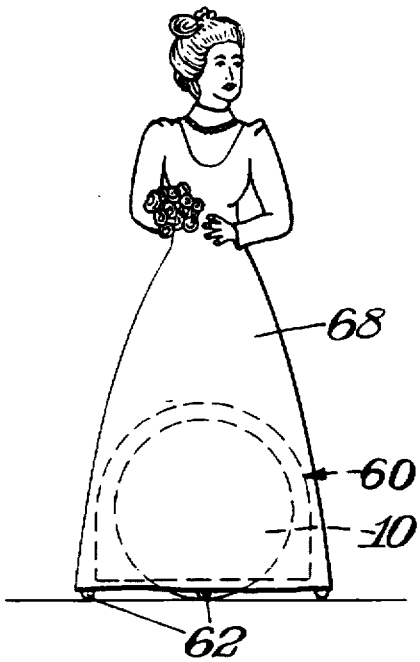
FIG. 10 is a perspective view of the embodiment of the invention shown in FIGS. 7–9 wherein the frame supports a simulated object.

FIG. 7 shows a two-dimensional caricature 66 formed on one of the surfaces, namely the top surface of the frame 60. This is the simplest form of utilizing the frame to indicate different simulated objects. FIG. 10, however, shows a preferred practice of the invention where the simulated object 68 is in three-dimensional form and is mounted on or secured to the frame. Where the object is three-dimensional and where the lower edge of the frame and the object are entirely out of contact with the floor or other support surface it is preferred that the center of gravity of the frame and object be located directly above the center of the ball so as to prevent tipping of the object. Alternatively, the lower edge of the three-dimensional structure and/or frame may reach the floor and have bearings which roll on the floor adding stability to the three-dimensional object whereupon the center of gravity need not be above the center of the ball.

It is to be understood that while FIG. 10 illustrates a cartoon type object, other three-dimensional structures may be used as supported by the frame. Such structure could include simulated live objects, such as persons or animals or could be dolls or cartoon characters. Other types of live objects include growing objects such as trees or flowers. The objects may also be inanimate objects such as concrete blocks or other structures.

Figure 11:
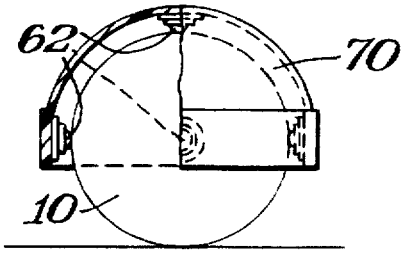
FIG. 11 is a side elevational view partly broken away showing an alternative form of frame in accordance with a further embodiment of this invention.

FIG. 11 shows an alternative form of frame which is not of box like construction as is frame 66. As is shown in FIG. 11 frame 70 is a flexible frame that would fit over ball 70 and generally conform to the arcuate shape of the ball. The frame 70 may be made of or coated with a low friction material such as TEFLON®. If desired, bearings 62 may also be included on any surfaces in contact with the floor.

The frame can thus take various forms. For example, the frame can be of rigid open bottom construction wherein the walls are solid and/or partially or fully skeletal such as a cage. Alternatively, the frame can be of flexible construction wherein the ball or other toy would move relative to the frame as where the frame is of box like structure. In yet a further form the frame could be a flexible shell made of plastic or cloth mounted completely around and thereby covering the ball or other toy in intimate contact with the ball.

Figure 12:
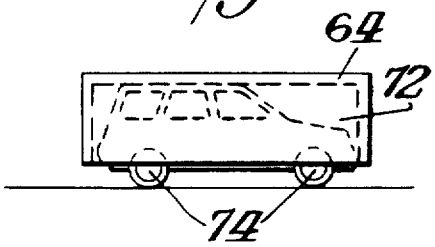
FIG. 12 is a side elevational view showing the use of a frame on a different type of rolling object in accordance with this invention.

Although the invention has been primarily concerned with a description of the remote controlled rolling toy in the form of a ball, it is to be understood that other types of remote controls may be used. FIG. 12, for example, illustrates the remote controlled toy 72 to be a vehicle having rolling wheels 74 with the frame 60 dropped over and supported by the vehicle.

Where the toy is used with a frame then the frame itself may carry the magnets previously described.

FIGS. 13–19 schematically illustrate use of the toy for playing various games. As shown in each of these figures the remote controlled toy with its frame is indicated by the reference numeral 80.

Figure 13:
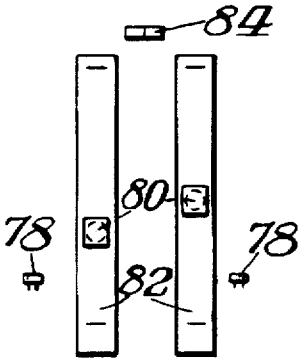
FIGS. 13–19 are schematic views showing use of the device of this invention in various types of games.

A simplified form of game could be racing. In such form as shown in FIG. 13 a plurality of tracks 82 would be provided and the toys 80 would race on the track controlled by remote control units 78. A timing device such as a clock 84 would determine which toy moved the fastest, i.e. reached the end of the track in the lowest time. Although FIG. 13 illustrates the tracks 82 to be straight unobstructed tracks, the tracks may have other variations such as being provided with dirt or other variable friction surfaces. Similarly, the tracks may be provided with devices such as loops or roller coasters or with obstacles. Additionally, the tracks may take circular or other non-straight linear forms.

Figure 14:
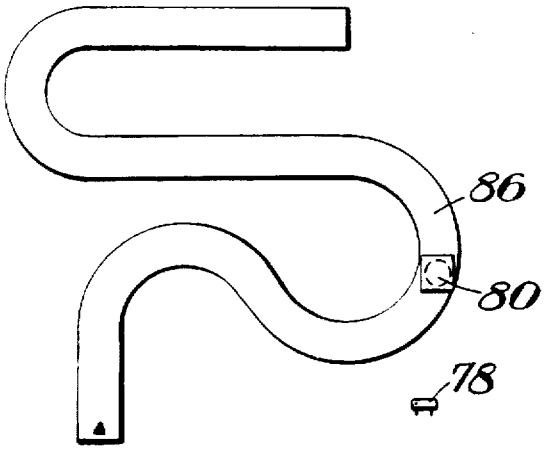

FIG. 14 illustrates use of the invention wherein the toy 80 is driven over an obstacle course or maze. As shown therein the course 86 is of irregular form. The object of the game would be for the user by means of remote control unit 78 to direct the toy 80 so as to negotiate the course 86 which may be provided with obstacles or which may be in the form of a maze. A plurality of identical courses could be provided to have competition between multiple users or the same course could be provided and the timing for each user could be recorded to determine the winner as being the one who is able to negotiate the course in the least amount of time.

Figure 15:
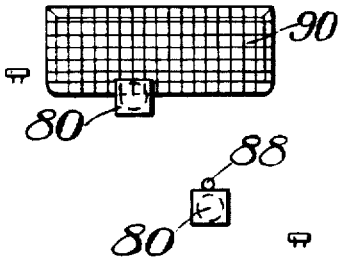

FIG. 15 shows use of the invention as part of a team sport. As illustrated therein the device 80 would correspond to an offensive player who would attempt to push a push member such as a soccer ball or a puck 82 into a goal or net 90. A second device 80 would be controlled by a different user to act as a goalie for preventing the soccer or puck from entering the net. The illustrated embodiment could also be used to simulate a soccer or hockey game.

The invention could be used for simulating a touch football game where one device 80 would represent the offensive player and another device 80 would represent a defensive player. The object would be for the offensive player to advance to the goal line before the defensive player touches the offensive player or runs the offensive player out of bounds. This game would be played on a simulated football field.

A variation of the touch football game could be a game of tag where two or more devices chase each other and try to make contact.

Figure 16:
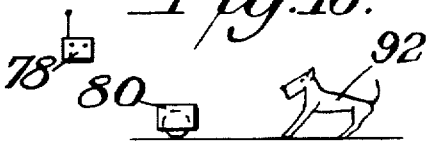

FIG. 16 illustrates use of the device 80 as part of an entertainment game for a pet 92, such as a dog or cat, where the device would bump or tease the pet and run away from the pet in a game of chase.

Figure 17:
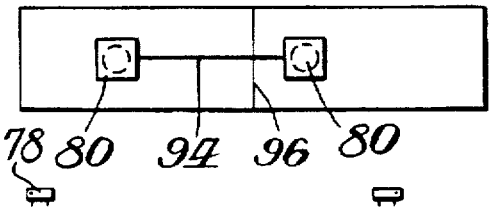

FIG. 17 illustrates use of two devices 80 having a cord 94 attached to each device in a game of tug of war. The individual devices 80 would be spaced an equal distance from a line 96 and the object of the game would be for one user to try to pull the other user's device over the line 96.

Figure 18:
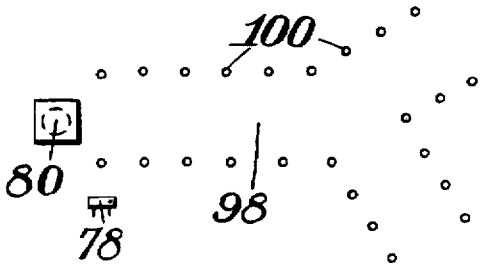

FIG. 18 illustrates a slalom/driver test type game where an obstacle course 98 would be provided and the user would be required to negotiate the device 80 to weave in and out of a series of posts or markers 100. Winning the game would be based on accuracy and/or the shortest amount of time.

Figure 19:
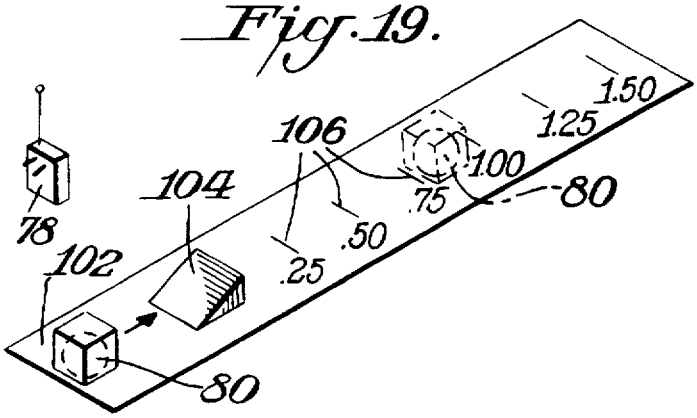

FIG. 19 illustrates a ski distance jumping game where the device 80 would be on a course 102 provided having a main surface which could be horizontal or inclined with a ramp 104 on the main surface. The course 102 could have distance marks 106 to readily indicate how far the device 80 jumps when moved over the ramp. FIG. 19 shows in phantom where the device has landed.

Although FIGS. 12–19 illustrate various games in which the device 80 could be used, other games are also possible. For example, the invention may be used to simulate sumo wrestling where two devices 80 would enter a ring and attempt to push or bump the other device out of the ring. A variation would be as gladiators where two or more devices would try to score goals by a player rolling his device into a cup defended by the opponent device.

A further variation is for simulated pocket billiards or pool where two or more devices would be used to hit balls (push members) into pockets on a pool table.

The invention could also be used for simulated shuffle board where two or more devices would compete on a shuffle board to see which ball comes the closest to the edge of the board without falling off. The shuffle board edge is preferably elevated above the floor, but could be planar with the floor.

Further variations include demolition derby ball where each device could have a pressure point or switch that causes the device to "explode" or break apart. Such devices would preferably be used in the form of balls or other toys without having the frame attached thereto. In this game two or more devices would crash into each other attempting to hit or activate the explode switch of the other device.

The invention could be practiced in the form of bumper/roller ball where two or more devices are raced around a circular or oval banked track. The devices would attempt to bump their opponent's device to keep the opponent's device from advancing around the track. A variation would be a velodrome/lap racing game where two or more devices are raced around a banked, circular or oval track. The first device to complete a given number of laps would be the winner.

The invention could also be used to simulate golf or miniature golf where the devices would hit a golf ball (push member) into a series of holes over a course. The lowest number of strokes or hits would be the winner.

A further practice of the invention could be in ring wrestling where two or more devices are put in a ring with preferably elastic cords or ropes on each side of the ring to delineate the ring. Cups, holes or openings would also be part of the ring. The object of the game would be to make the opponent's device bounce off the ropes and maneuver the opponent's device to knock it through an opening in the ring such as the corners into a hole or cup where the opponent's device becomes disabled and the round is won.

Although the invention has been particularly described with respect to rolling toys which roll on hard surfaces, the invention may also be used where the toy is a water toy and the "rolling" in a sense is a sliding in water. For example, the simulated device could be a waterproof boat equipped with paddles which are caused to rotate by the remote control so that toy can run in water. The propelled water toy can be a boat or a floating duck, etc.

It is to be understood that the various games may be played without the use of any frame to create a simulated animate or inanimate object. Depending on the game it might be preferred to enhance the enjoyment, however, to include the frame. Such frames, as previously noted could be of any animate or inanimate nature including dolls, cartoon characters, animals, toy soldiers, bugs, etc. Preferably the frame would include a three-dimensional structure simulating a player of the game, e.g. hockey player, wrestler, runner, etc.

Where the invention is utilized as part of an aquatic game the support surface would be considered a non-rigid path and the paddles would be considered as a movable support contacting surface. Where the invention is used for land type games the support surface would be rigid, such as a floor or the ground. Alternatively, the support surface could have less rigid characteristics, such as having dirt or other material on the surface. Depending on the actual game the path could be a straight linear planar path such as used in hockey, wrestling, football, etc. or could be a path having different elevations such a banked track or the edge of a shuffle board or a ramp on a track. Similarly, the track could be a non-straight linear path such as in lap racing, utilizing a maze or in games having random paths, such as chase games where an animal would chase the object.

What is claimed is:

1. A remote controlled rolling toy assembly comprising a toy having at least one rolling surface for being in rolling contact with a support surface, a drive unit in said toy having a drive mechanism for causing said rolling surface to rotate upon actuation of said drive unit, a remote control unit for selectively actuating and inactivating said drive unit to selectively cause said toy to move over the support surface, a frame detachably mounted over said toy, said frame having structure for simulating an animate/inanimate object, said rolling surface being a spherical ball having a horizontal diameter at the widest portion of said ball, said frame having an inner wall surface and a lower edge, said lower edge extending to at least said horizontal diameter, said frame and said ball making multi-point contact with said ball including at a plurality of locations at said widest portion of said ball, said inner wall surface of said frame and said ball making low friction contact with each other at said points of contact, and the minimum spacing between opposite portions of said inner wall surface of said frame at said horizontal diameter and downward to said lower edge being at least as great as the length of said horizontal diameter to facilitate the mounting and removal of said frame from said ball, a second frame having a structure for simulating a different object, said second frame capable of being dropped on and over the toy to replace the other frame in use.

2. The assembly of claim 1 wherein said structure is a three-dimensional animate/inanimate structure mounted on said frame.

3. The assembly of claim 2 wherein the center of gravity of said three-dimensional structure is generally directly above said toy.

4. The assembly of claim 3 wherein said frame and said three-dimensional structure terminates at a height above the lowest part of said rolling surface.

5. The assembly of claim 4 including bearing members at each point of contact of said frame with said toy to comprise said low friction contact.

6. The assembly of claim 2 wherein at least one of said frame and said structure includes bearing members for contacting the support surface.

7. The assembly of claim 1 wherein said toy is a ball, and said remote control unit controlling the direction and speed of movement of said ball.

* * * * *